US005988934A

United States Patent [19]

Wasserstrom

[11] Patent Number: 5,988,934

[45] Date of Patent: Nov. 23, 1999

[54] HIGHWAY BARRIER

[75] Inventor: David E. Wasserstrom, Elkins Park, Pa.

[73] Assignee: Traffic Safety Devices Corporation, Elkins Park, Pa.

[21] Appl. No.: 09/174,791

[22] Filed: Oct. 19, 1998

[51] Int. Cl.[6] ..... E01F 13/02

[52] U.S. Cl. ..... 404/6; 404/7; 256/13.1

[58] Field of Search ..... 404/6, 7; 256/13.1, 256/1; 403/13, 14, 334; 52/591.4, 592.3

[56] References Cited

U.S. PATENT DOCUMENTS

| | | | |
|---|---|---|---|
| D. 341,098 | 11/1993 | Yodock . | |
| D. 343,369 | 1/1994 | Sprague . | |
| D. 385,362 | 10/1997 | Rossetti . | |
| 3,326,099 | 6/1967 | Cova et al. | 404/7 |
| 4,681,302 | 7/1987 | Thompson | 404/6 |
| 4,773,629 | 9/1988 | Yodock . | |
| 4,869,617 | 9/1989 | Chiodo | 404/6 |
| 4,946,306 | 8/1990 | Yodock . | |
| 5,011,325 | 4/1991 | Antonioli | 256/13.1 |
| 5,104,254 | 4/1992 | Durand . | |
| 5,104,255 | 4/1992 | Bodensohn | 404/7 |
| 5,123,773 | 6/1992 | Yodock | 404/6 |
| 5,208,585 | 5/1993 | Spraque | 404/6 |
| 5,336,016 | 8/1994 | Baatz | 404/6 |
| 5,387,049 | 2/1995 | Duckett . | |
| 5,498,101 | 3/1996 | Braverman . | |
| 5,531,540 | 7/1996 | Wasserstrom et al. . | |
| 5,611,641 | 3/1997 | Christensen . | |
| 5,836,714 | 11/1998 | Christensen | 404/6 |

*Primary Examiner*—Thomas B. Will
*Assistant Examiner*—Kristine M. Markovich
*Attorney, Agent, or Firm*—Lerner, David, Littenberg, Krumholz & Mentlik, LLP

[57] ABSTRACT

A road barrier, which may be the portable type having a hollow body. The road barrier is adapted to be connected to one or more other barriers having the same or similar construction to form a continuous barrier wall of a desired length.

19 Claims, 6 Drawing Sheets

HIGHWAY BARRIER

FIELD OF THE INVENTION

The present invention relates to road barriers. More particularly, the present invention relates to portable road barriers which are intended to prevent a vehicle from penetrating into a desired area.

BACKGROUND OF THE INVENTION

The use of road barriers on highways have proven to be effective at reducing the number of series injuries and fatalities caused by automobile accidents. Road barriers have also proven to be effective at reducing damage which would otherwise occur to vehicles that become displaced from their proper path along a roadway.

While road barriers are typically used on highways or the like, such barriers have also been used to prevent vehicular penetration into other areas such as work zones, pedestrian walkways, etc.

Notwithstanding the proven usefulness and effectiveness of highway barriers, safety concerns have prompted manufacturers of highway barriers to continue to exert great efforts to develop improved barriers to isolate desired areas and to reduce the risk of injury to occupants and vehicles and damage to the vehicles.

Portable barriers which include a hollow body and may later be filled with a fluid or solid material to increase the mass of the barriers have been particularly desirable due to advantages associated with transporting and setting up such barriers. Portable highway barriers typically include an elongated container made of semi-rigid plastic material which is self-supporting and which has a predetermined shape. These containers may be filled with water and other fluids substances such as sand, chipped rubber and the like in order to substantially increase the mass of such barriers and to maintain the shape thereof. It is also known in the prior art for both portable and permanent highway barriers to include various sections which can be interconnected in an end-to-end configuration in order to form a continuous barrier wall of a desired length.

Although the aforementioned prior art hollow barriers have been useful, a need continues to exist for a barrier system which can easily and quickly be assembled and which provides enhanced stability when in an assembled position.

SUMMARY AND OBJECTS OF THE INVENTION

The present invention addresses the aforementioned needs by providing a road barrier comprising a container having a base portion, a top portion, first and second side walls and first and second end walls. A protrusion is attached to the first end wall and extends vertically between the base and top portions. A locking pin is attached to the protrusion and preferably extends downwardly therefrom. A receptacle is preferably arranged within the second wall and extends vertically between the base and top portion. A vertically oriented socket may be arranged within the base portion and is aligned within the receptacle for a later arrangement with a locking pin of an adjacent road barrier.

In a preferred embodiment, the container and the components thereof, including the protrusion, locking pin, receptacle and socket are integrally formed by a rotational molding process. However, in alternate embodiments, the container may include one or more separable components.

It is preferable for the road barrier to be the portable type which is hollow and can be filled with a fluid or other substance such as water, sand, concrete, etc. The container may be formed of various materials and preferably comprises a polymer. In one embodiment, the container and all components thereof may be made of a low density polyethylene.

The container may have a height defined by the base and top portions and the protrusion may extend along substantially the entire height of the container. Similarly, the receptacle may also extend along substantially the entire height of the container. The protrusion and the corresponding receptacle may have various shapes and configurations. For example, the protrusion may be cylindrical, square, etc. Preferably, the receptacle will have a configuration which corresponds to that of the protrusion so as to facilitate end-to-end connection of road barriers.

The base portion may include a platform section in which the vertically oriented socket is arranged. In this embodiment, the platform section preferably extends into the channel of the receptacle at the second end wall of the container. In another embodiment, the platform section may include a ramp portion substantially adjacent to the locking socket so as to facilitate slidable end-to-end connection to another container. In another preferred embodiment, the locking pin may have its bottom most end arranged vertically above the bottom most portion of the base portion of the container.

Preferably, the container has a generally elongated configuration. An imaginary longitudinal central axis may extend through the first and second end walls of the container. It is preferable for the first and second end walls to include outer most edges at opposing sides of the central axis. The first and second end walls of the container preferably adjoin respective first and second side walls at the outer most edges thereof. The first and second end walls may be inwardly tapered at a selected angle from the central axis to the outer most edges thereof. In a preferred embodiment, the selected angle of the first and second end walls may be between about 5°–10° with respect to a horizontal tangent line. It is also desirable for the receptacle to include outwardly tapered walls so as to facilitate movement of respective road barriers sections around curves when connected in an end-to-end configuration.

Accordingly, it is an object of the present invention to provide a road barrier which can be easily and securely connected to one or more adjacent road barriers in an end-to-end configuration.

In is another object of the present invention to provide a road barrier having a locking mechanism to secure adjacent road barriers in an end-to-end configuration.

It is yet another object of the present invention to provide a road barrier having a structure which facilitates slidable assembly to an adjacent road barrier section.

The above assembly, as well as other objects, features and advantages of the present invention will be more fully understand when considered in conjunction with the following detailed description of the preferred embodiments and the corresponding drawings.

DETAILED DESCRIPTION OF THE PREFERRED EMBODIMENTS

Figure 1:
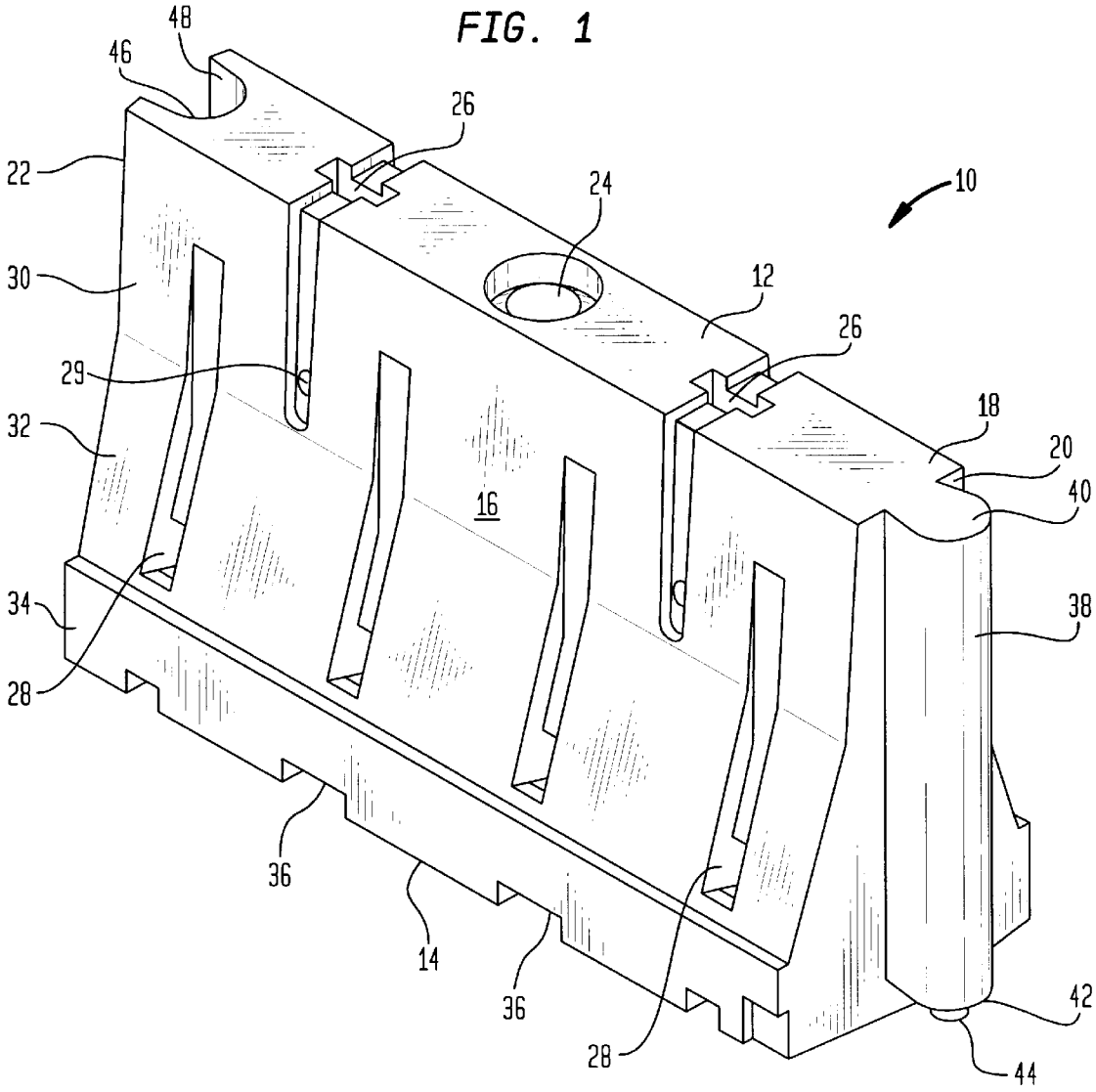
FIG. 1 is a perspective view of the present road barrier.
Figure 2:
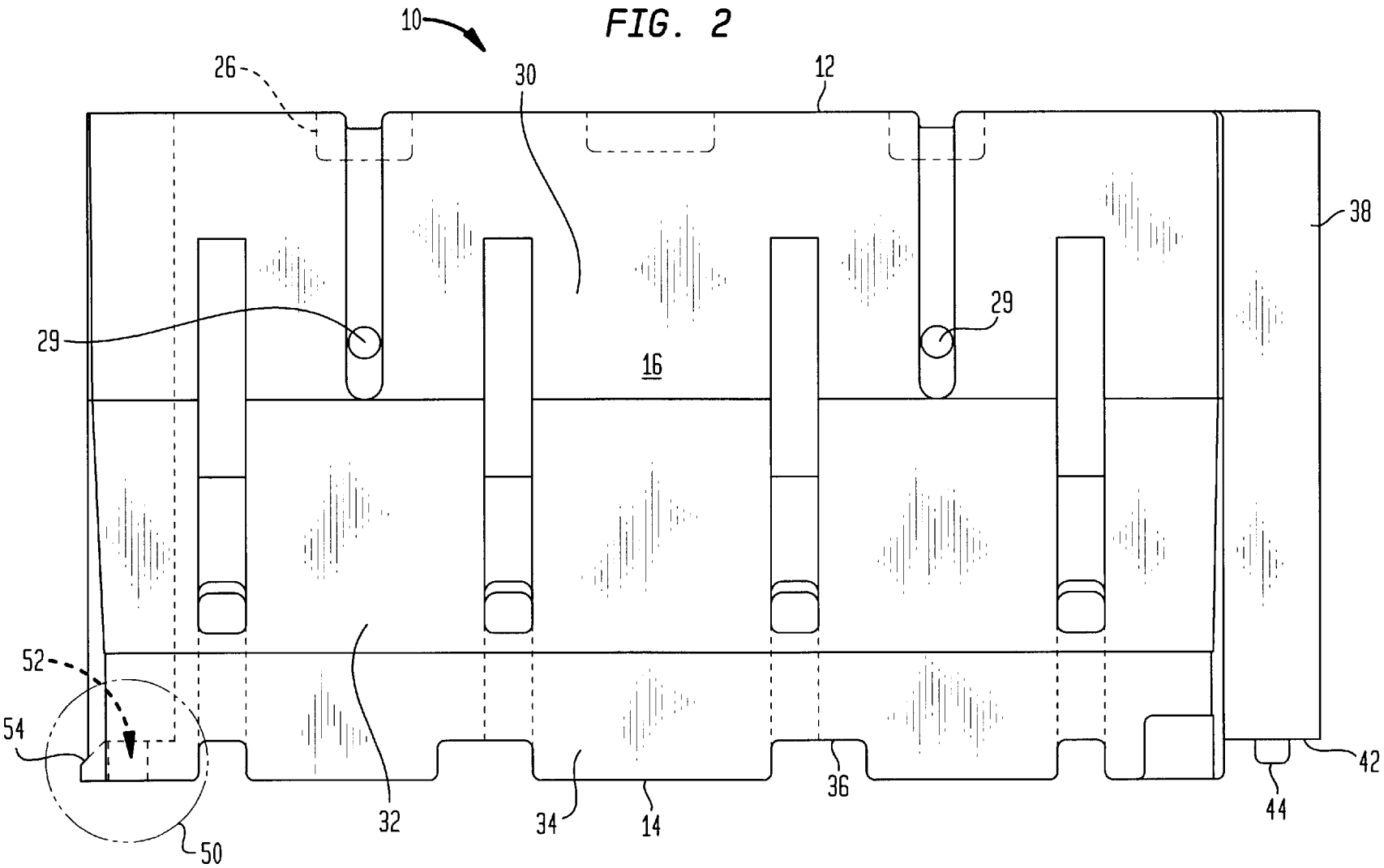
FIG. 2 is a front view of the road barrier shown in FIG. 1.

In accordance with a preferred embodiment of the present invention, a road barrier 10 may be used either by itself or in combination with one or more additional road barrier sections to secure a work zone or other designated area. As clearly illustrated in FIGS. 1–5, the road barrier includes a top portion 12, a base portion 14, opposing front and rear sides 16 and 18, and opposing right and left ends 20 and 22. The base portion 14 is shown in the drawings as being substantially wider than the top portion 12 as it forms a stable base for the road barrier 10 when placed on a road surface.

In the preferred embodiment shown in FIGS. 1–9, the road barrier 10 is a portable barrier and may comprise a single hollow container made of a polymeric material or the like. For example, the road barrier 10 may be made of a recyclable low density polyethylene. However, it should be appreciated that various additional semi-rigid and rigid materials may be used to construct the road barrier 10. Further, it should be appreciated that the portability aspect is an optional feature of the present invention as the road barrier 10 can also be used as a permanent highway barrier.

When used as a portable barrier, the road barrier 10 comprises a container which is initially hollow. A filling hole 24 is centrally arranged at the top portion 12 to permit fluid materials to be placed within the hollow cavity of road barrier 10 so that its mass can be increased as desired. Suitable filling materials are known in the art and may include water, sand, rubber chips, concrete, etc. It is particularly desirable to use water when the road barrier 10 is used as a portable unit as the water can easily be drained through one or more drain holes 31 arranged at the base portion 14. After the road barrier 10 is filled with a desired fluid material, the filling hole 24 may be closed with a suitable cap (not shown).

In its empty state, the hollow container of the road barrier 10 may weigh less than 135 pounds. Depending on the material used, the container or road barrier 10 may accommodate up to about 1525 pounds when filled while still retaining its shape and structural integrity.

As shown in FIGS. 1–3 and 9, the top portion 12 of the road barrier 10 includes a pair of slots 26 which are adapted to receive height increasing devices such as screens and like (not shown) or sign post (also not shown) for retaining signs in conjunction with the road barrier 10.

The front and rear sides 16 and 18 of the road barrier 10 may be symmetrical. Thus, while various features of the front side 16 are illustrated in detail in FIGS. 1 and 2, it should be appreciated that the identical features may be present on the read side 18 thereof. In particular, the front side 16 is shown in FIGS. 1, 2, 4, 5 and 9 as having three general sections. In particular, the upper section 30 of the side wall 16 extends upwardly at a very slight angle with respect to a vertical axis. The central portion 32 slopes at a substantially steeper angle of about 25° with respect to a vertical axis. Finally, the lower section 34 extends vertically between the base portion 14 and the sloping central section 32 of the front side 16.

Channels 28 extend vertically and horizontally within the front side 16 beginning at the top of the lower section 34 and continuing within the central section 32. Such channels correspond with internal baffles which add structural integrity to the road barrier 10. Additionally, molded air passageways 29 extend between the front and rear sides 16 and 18, and also add structural integrity to the road barrier 10. Further, passageways 29 are adapted to receive a portion of a reinforcement system (not shown) for distributing forces which would otherwise be directly applied to the road barrier 10.

A pair of slots 36 extend horizontally through the base portion 14 and the bottom of the vertical rise section 34 of the front side 16 to facilitate lifting and manipulation of the road barrier 10 by a forklift.

Figure 3:
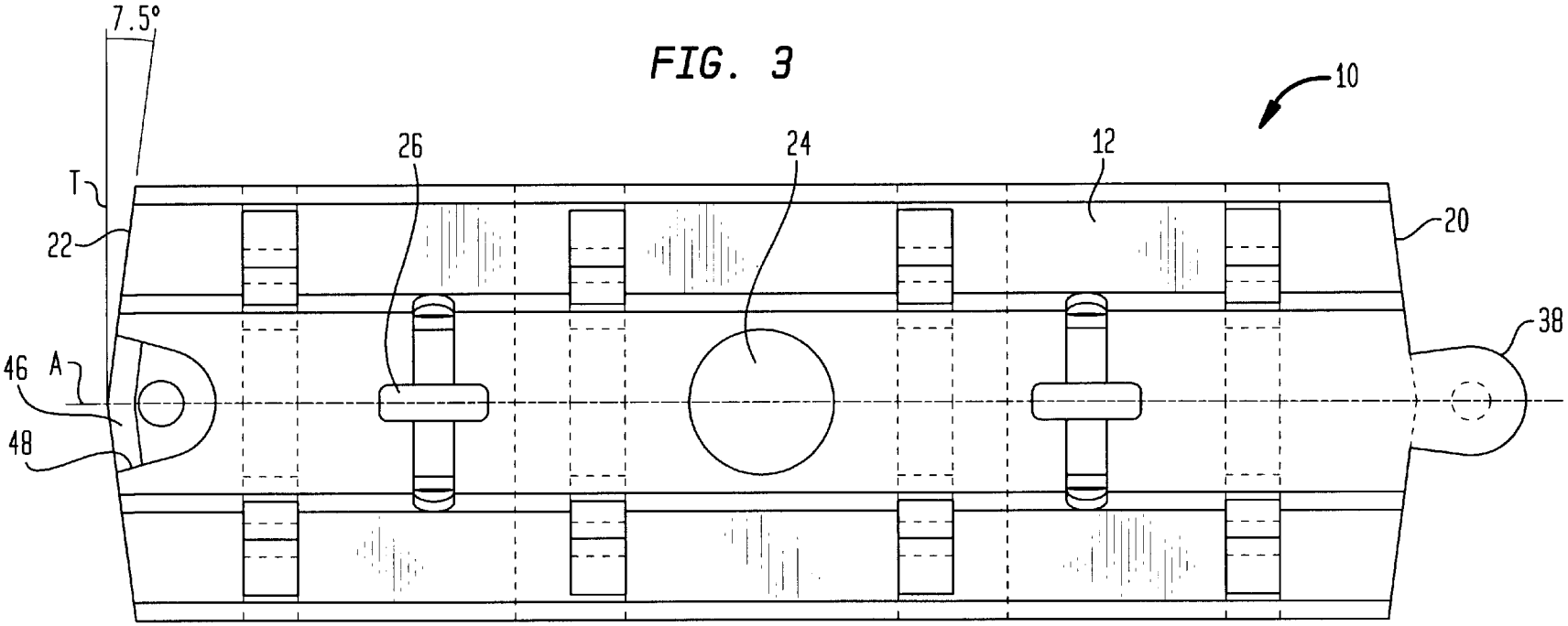
FIG. 3 is a top plan view of the road barrier shown in FIG. 1.
Figure 5:
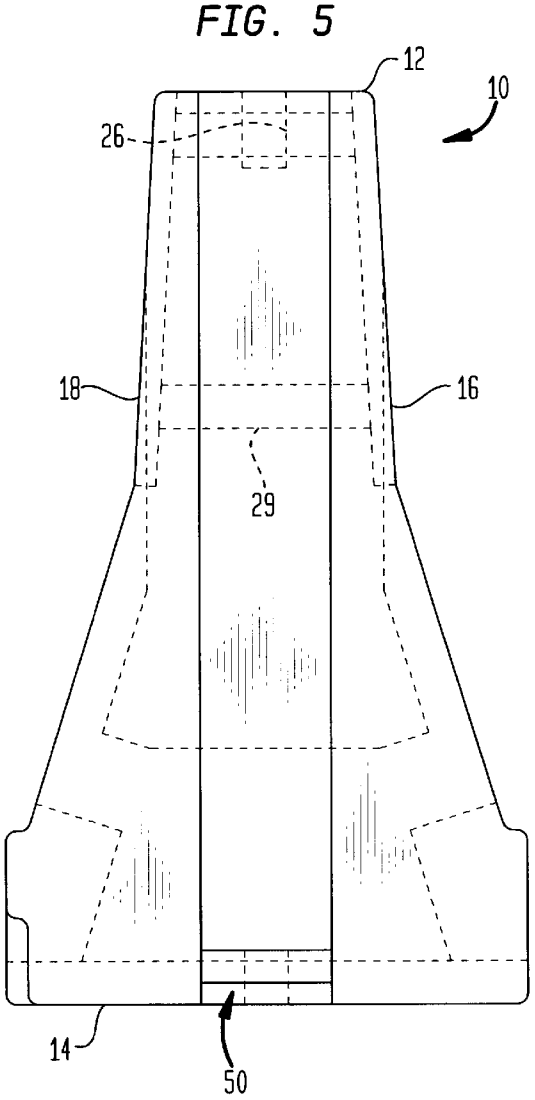
FIG. 5 is a left end view of the road barrier shown in FIG. 1.
Figure 4:
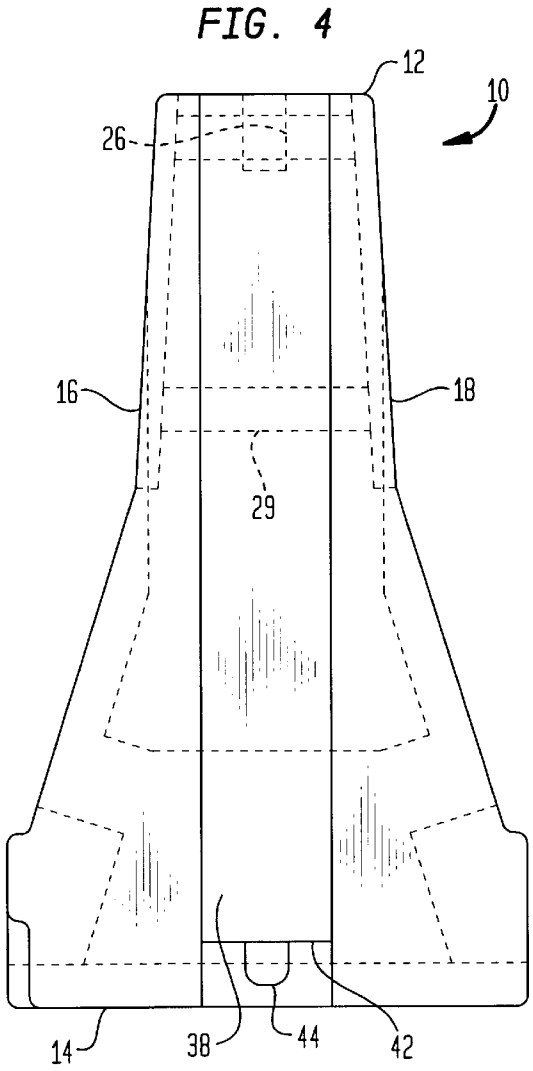
FIG. 4 is a right end view of the road barrier shown in FIG. 1.

As best shown in FIG. 3, an imaginary longitudinally extending axis is illustrated extending through the center of the right and left ends 20 and 22 along the entire length of the top portion 12. Similarly, an imaginary horizontal tangent line T is illustrated with respect to the left end 22 of the road barrier. As discussed further below, the tangent line T and the longitudinal axis A are useful to illustrate the inwardly tapered arrangement of the end walls 20 and 22.

As shown in FIGS. 1, 2, 4 and 5, the road barrier 10 includes a cylindrical protrusion 38 extending from the right end wall 20. The cylindrical protrusion 38 has a top section 20 and a bottom section 42. As evident from the drawings, the cylindrical protrusion 38 extends substantially the entire height of the road barrier 10 between the top and base portions 12 and 14 thereof.

An important aspect of the present invention pertains to a locking structures which facilitate connection of the road barrier 10 to additional road barrier sections. In this regard, a locking pin 44 is integral with and extends downwardly from the bottom 42 of the cylindrical protrusion 38. However, it should be appreciated that in alternate embodiments, the locking pin 44 may comprise a separable component which extends downwardly from the cylindrical protrusion 38. Further, the shape and configuration of the protrusion may vary in alternate embodiments.

At the opposing end of the road barrier 10, the left end wall 22 includes an elongated receptacle 46 formed therein. This aspect of the present invention is clearly illustrated in FIGS. 1–3, 5 and 9. Like the cylindrical protrusion 38, the elongated receptacle 46 extends substantially the entire height of the road barrier between the top and base portions 12 and 14. Like the protrusion 38, the shape and configuration of the receptacle may vary in alternate embodiments. However, it is desirable for the shape of the receptacle 46 to correspond to that of the protrusion in order to facilitate most effective connection of adjacent road barriers. In the embodiment shown in the accompanying drawings, the elongated receptacle 46 includes an outwardly tapered wall 48 which facilitates adjustability of a barrier system where a plurality of road barriers 10 are connected in an end-to-end configuration as discussed further below.

Another component of the locking feature of the present invention is arranged at the base of the road barrier within the elongated receptacle 46. In particular, the base portion 14 of the roadway barrier 10 includes a platform 50 which extends across the bottom most portion of the elongated receptacle 46. A cylindrical socket 52 is formed within the platform portion 50 of the base 14. As clearly illustrated in FIGS. 2–8, the socket 52 is vertically oriented and is sized and shaped to receive the locking pin 44 of an adjacent roadway barrier 10 when in an end-to-end configuration.

Figure 7:
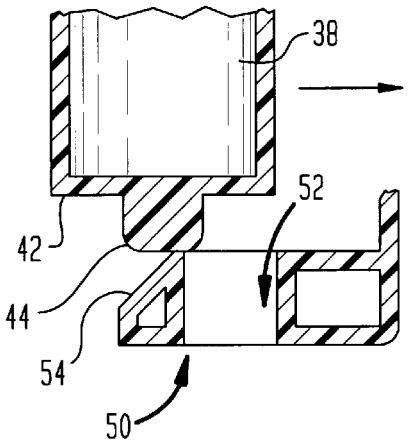
FIG. 7 is an isolated cross-sectional view of the relationship between the locking pin and socket of the present invention as two road barriers are further in the process of being assembled in an end-to-end configuration.
Figure 8:
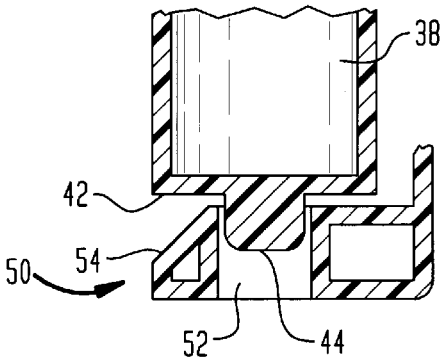
FIG. 8 is an isolated cross-sectional view of the relationship between the locking pin and socket of the present invention as two road barriers are still further in the process of being assembled in an end-to-end configuration where the locking pin of one barrier is arranged within a corresponding socket of another barrier.
Figure 9:
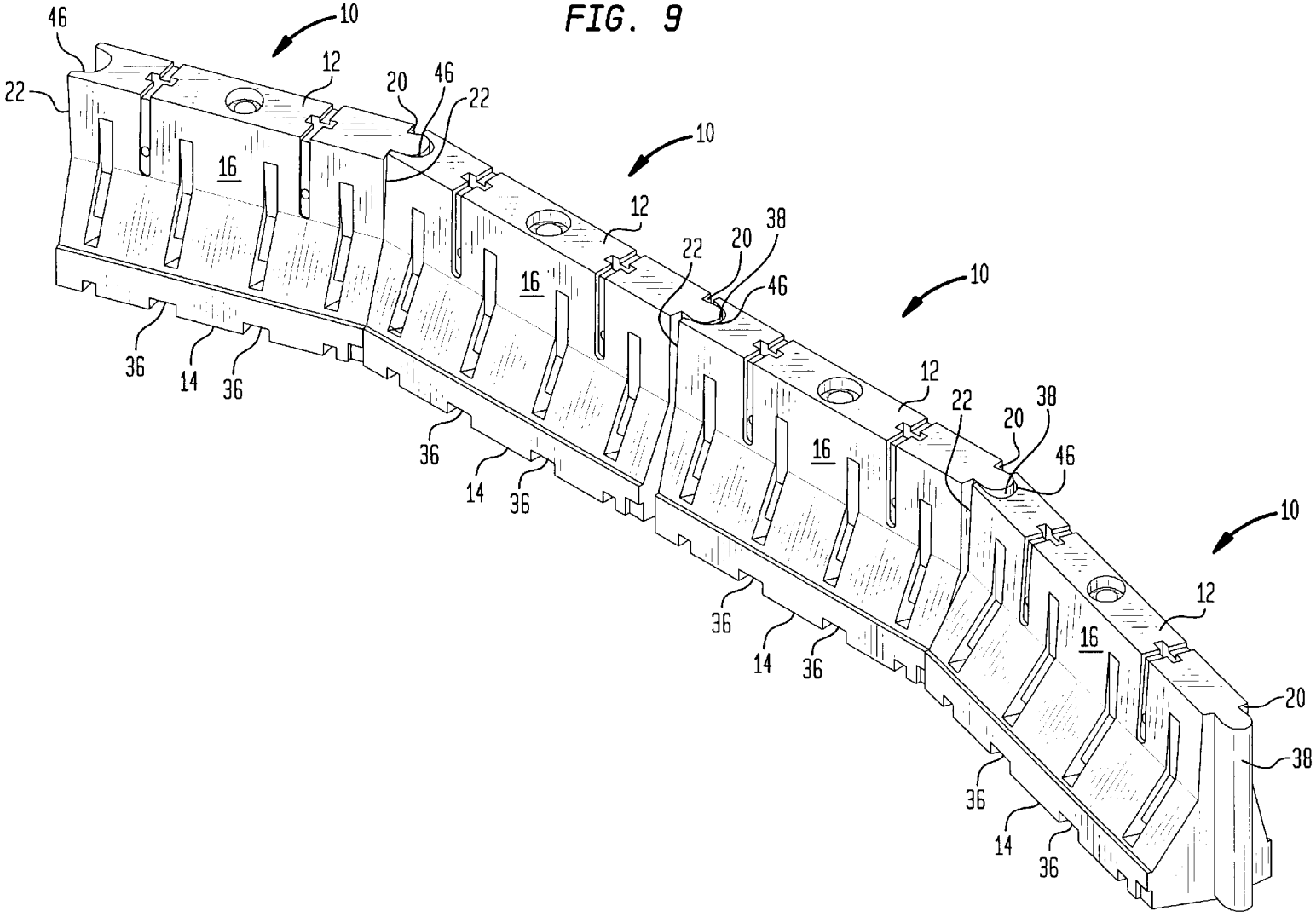
FIG. 9 is an isometric view of a barrier system made of four road barrier sections assembled in an end-to-end configuration.

Another important aspect of the present invention pertains to the ability to slide the roadway barriers into engagement with an adjacent roadway barrier when assembling a barrier system 56, such as that shown in FIG. 9. With reference to FIGS. 2 and 6–8, this aspect of the present invention is facilitated by ramp portion 54 of the platform 50. The ramp portion 54 begins at the left most end of the road barrier 10 and terminates substantially adjacent to the vertically oriented socket 52. The size and shape of the socket 52 should be selected to accommodate receiving the locking pin 44 therein as the cylindrical protrusion 38 is arranged within the elongated receptacle 46.

The road barrier 10 may be manufactured by various methods. However, in a preferred embodiment the road barrier 10 is manufactured by a rotational molding method. Such a method will ensure that the road barrier 10 is water tight.

Although the size and configuration of the various features and components of road barrier 10 may vary widely within the scope of the present invention, in an exemplary embodiment, the road barrier 10 may have an overall height of forty two inches extending between base portion 14 and top portion 12. The width of base portion 14 may be twenty four inches. The "usable" length of road barrier 10 between the left most portion of left end wall 22 and the right end wall 20 (excluding the cylindrical protrusion 38) is about seventy two inches. The protrusion 38 extends outwardly from the right end wall 20 by about an additional six inches. However, since the protrusion 38 is intended to be inserted within the corresponding elongated receptacle 36 of an adjacent road barrier 10, the six inch length thereof is not considered part of the "usable" length.

The elongated receptacle 46 formed within the left end wall 22 may have a radius of three inches and a total depth of about six inches: Further, it is particularly sized and shaped to receive a corresponding cylindrical protrusion 38 of an adjacent road barrier 10. As evident from FIG. 3, both sides (front and rear) of the left end wall 22 is tapered inwardly at a slight angle which may be between 5–10 degrees with respect to tangent line T. Similarly, both sides of the right end wall 20 also taper inwardly with respect to an imaginary tangent line (not shown) at an angle of between about 5–10 degrees. This inwardly tapered configuration of both sides of the left and right end walls 22 and 20 facilitate the ability of a completed barrier system 56, which comprises a plurality of road barriers 10, to extend around curves. Thus, when a plurality of road barriers 10 are arranged in end-to-end configuration, corresponding adjacent end walls are designed so that the connected road barriers 10 can form a straight line, or alternatively can be used to form a larger curved barrier. If for example, the inwardly tapered left and right end walls are arranged at a 7.5 degree angle with respect to a horizontal tangent line T, two connected road barriers 10 can effectively be arranged to form at an angle of up to 15 degrees.

The road barrier 10 may be rotationally molded out of a recyclable low density polyethylene to a uniform thickness of approximately eight mm. As the road barrier 10 may be exposed to harsh environments, it may be desirable to incorporate an ultraviolet light inhibitor into the raw material mix used to manufacture the polyethylene in order to extend the life expectancy thereof.

An advantage obtained by the structure of the present invention is evident when constructing a road barrier system 56 from a plurality of individual road barriers 10. FIG. 9 illustrates an end-to-end configuration of such a plurality of road barriers 10 to form a road barrier system 56. As evident from FIG. 9, a chain of road barriers 10 can be created by placing the cylindrical protrusion 38 into elongated receptacle 46 of an adjacent barrier. Unlike many prior art barriers which must be manually lifted and placed into assembled position when connected to an adjacent barrier section, the road barrier 10 can simply slide into assembled position with respect to an adjacent road barrier until it is locked into place by the combination between the locking pin 44 and the vertically oriented socket 52.

The ability to slide into a locked position is achieved by a unique structure including ramp portion 54 of the platform 50 which terminates substantially adjacent to the socket 52. This feature of the present invention can best be appreciated with reference to FIG. 6–8. In this regard, FIG. 6–8 show isolated broken-away portions of the locking pin 44 and corresponding socket 52 assemblies of adjacent road barriers as such barriers slide into assembled position where the locking pin 44 of a first road barrier 10 is finally placed within a corresponding socket 52 of a second road barrier.

Figure 6:
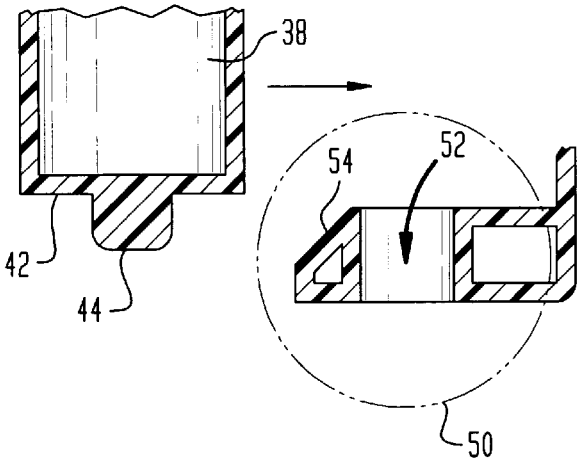
FIG. 6 is an isolated cross-sectional view of the relationship between the locking pin and socket of the present invention as two road barriers are in the process of being assembled in an end-to-end configuration.

More particularly, FIG. 6 illustrates the relationship between a locking pin 44 extending downwardly from cylindrical protrusion 38 as the associated road barrier 10 slides into engagement with the platform portion 50 of the base 14 of an adjacent road barrier. As a horizontal force continues to be applied to the road barrier 10, the locking pin 44 slides up the corresponding ramp 54 of the road barrier to which it is to be connected. This aspect of the present invention is shown with reference to FIG. 6 where the locking pin 44 of a first road barrier 10 initially comes into contact with the ramp portion 54 of a second road barrier. As a horizontal force continues to be applied to the first road barrier in the direction of the arrows shown in FIGS. 6 and 7, the locking pin 44 proceeds to slide up the ramp portion 54 of an associated road barrier. Finally, the locking pin 44 falls into its assembled position within the vertically oriented socket 52 of the other road barrier as illustrated in FIG. 8.

Once the road barriers are arranged in assembled position, the cooperation between the locking pin 44 and socket 52 creates a particularly secure environment. If disassembly desired, the road barriers may be drained (assuming they are filled with water or the like) and may thereafter be easily removed from their assembled position.

While prior art road barriers previously had the ability to slide into and out of assembled position, such prior art barriers did not have an advantageous locking structure such as that of the present invention.

While the foregoing description and accompanying figures are directed toward preferred embodiments of the present invention, it should be appreciated that numerous modifications can be made to the structure and components of the present invention. Indeed, such modifications are encouraged to be made in the materials, configuration, dimension, structure and arrangement of the components of the present invention without departing from the scope of the claims set forth below. Thus, the foregoing description of the preferred embodiments should be taken by way of illustration rather than by way of limitation.

I claim:

1. A road barrier comprising:

a container having a base portion, a top portion, first and second side walls and first and second end walls;

a protrusion attached to said first end wall and extending vertically between said base and top portions;

a locking pin attached to said protrusion and extending downwardly therefrom;

a receptacle arranged within said second end wall and extending vertically between said base and top portions; and a vertically oriented socket arranged within said base portion and being aligned within said receptacle, said base portion includes a platform section in which said locking socket is arranged, said platform section extending into said receptacle of said second end wall, said platform section having a ramp portion with an angled surface substantially adjacent said locking socket so as to facilitate slidable end-to-end connection to another road barrier of the same or similar construction whereby said protrusion of said first end wall is arranged within a receptacle of a second end wall of the other road barrier while said locking pin attached to said protrusion is arranged within a vertically oriented socket of such other road barrier thereby securing the road barrier in assembled position.

2. The road barrier of claim 1 wherein said protrusion is integral with said first end wall.

3. The road barrier of claim 2 wherein said locking pin is integral with said protrusion.

4. The road barrier of claim 1 wherein said container comprises a polymer and is formed by rotational molding.

5. The road barrier of claim 1 wherein all components thereof are formed as an integral container by rotational molding.

6. The road barrier of claim 1 wherein said container has a height defined by said base and top portions, said protrusion extending along substantially the entire height of said container.

7. The road barrier of claim 6 wherein said receptacle extends along substantially the entire height of said container.

8. The road barrier of claim 1 wherein said locking pin has a terminated bottom most end arranged vertically above the bottom most portion of said base portion.

9. The road barrier of claim 1 wherein said container has a generally elongated configuration, an imaginary longitudinal central axis extending between said first and second end walls of said container.

10. The road barrier of claim 9 wherein each of said first and second end walls include outer most edges at opposing sides of said central axis, said first and second end walls adjoining respective said first and second side walls at said outer most edges, said first and second end walls being inwardly tapered at a selected angle from said central axis to said outer most edges thereof.

11. The road barrier of claim 10 wherein said selected angle of said first and second end walls is between about 5°–10°.

12. The road barrier of claim 1 wherein said receptacle includes outwardly tapered walls.

13. A road barrier comprising:

a container having a base portion, a top portion, first and second side walls and first and second end walls;

a protrusion integrally attached to said first end wall and extending vertically between said base portion and top portions;

a locking pin integrally attached to said protrusion and extending downwardly therefrom;

a receptacle formed within said second end wall and extending vertically between said base and top portions; and a vertically oriented socket formed within said base portion and being aligned within said receptacle, said base portion including a platform section having a ramp portion with an angled surface substantially adjacent said locking socket so as to facilitate slidable end-to-end connection to another road barriers of the same or similar construction whereby said vertically extending protrusion of said first end wall may be arranged within a vertically extending receptacle of a second end wall of the other road barrier while said locking pin is arranged within a socket of such other road barrier thereby securing the road barrier in assembled position.

14. The road barrier of claim 13 wherein said container comprises a polymer and is formed by rotational molding.

15. The road barrier of claim 13 wherein said container has a height defined by said base and top portions, said protrusion extending along substantially the entire height of said container.

16. The road barrier of claim 13 wherein said receptacle extends along substantially the entire height of said container.

17. The road barrier of claim 13 wherein said locking pin has a terminated bottom most end arranged vertically above the bottom most portion of said base portion.

18. The road barrier of claim 13 wherein said container has a generally elongated configuration, an imaginary longitudinal central axis extending between said first and second end walls of said container.

19. The road barrier of claim 13 wherein each of said first and second end walls include outer most edges at opposing sides of said central axis, said first and second end walls adjoining respective said first and second side walls at said outer most edges, said first and second end walls being inwardly tapered at a selected angle from said central axis to said outer most edges thereof.

* * * * *